US010183263B2

(12) United States Patent
Nichols

(10) Patent No.: US 10,183,263 B2
(45) Date of Patent: Jan. 22, 2019

(54) MIXING APPARATUS AND METHOD FOR MIXING FLUID IN A VESSEL

(71) Applicant: SCIENTIFIC INDUSTRIES, INC., Bohemia, NY (US)

(72) Inventor: Robert P. Nichols, Rocky Point, NY (US)

(73) Assignee: SCIENTIFIC INDUSTRIES, INC., Bohemia, NY (US)

( * ) Notice: Subject to any disclaimer, the term of this patent is extended or adjusted under 35 U.S.C. 154(b) by 280 days.

(21) Appl. No.: 15/192,496

(22) Filed: Jun. 24, 2016

(65) Prior Publication Data

US 2017/0368516 A1 Dec. 28, 2017

(51) Int. Cl.

| | |
|---|---|
| ***B01F 9/10*** | (2006.01) |
| ***B01F 9/00*** | (2006.01) |
| ***B01F 15/00*** | (2006.01) |

(52) U.S. Cl.

CPC ..... *B01F 9/0016* (2013.01); *B01F 9/0014* (2013.01); *B01F 9/0021* (2013.01); *B01F 15/00733* (2013.01)

(58) Field of Classification Search

CPC ..... B01F 9/0014; B01F 9/10
USPC ..... 366/208–211, 213, 216, 217
See application file for complete search history.

(56) References Cited

U.S. PATENT DOCUMENTS

| | | | | |
|---|---|---|---|---|
| 1,688,665 A * | 10/1928 | Smellie | D06F 27/00 | 366/211 |
| 2,635,473 A * | 4/1953 | Rampe | B01F 9/0014 | 366/213 |
| 3,401,034 A * | 9/1968 | Moore | F27D 27/00 | 266/233 |
| 3,430,927 A * | 3/1969 | Pouzar | B01F 9/103 | 366/213 |
| 6,837,843 B2 * | 1/2005 | Gazeau | B04B 5/0421 | 366/214 |

* cited by examiner

*Primary Examiner* — David L Sorkin
(74) *Attorney, Agent, or Firm* — F. Chau & Associates, LLC

(57) ABSTRACT

A mixing apparatus includes a motor. A first plate is connected to the motor. The first plate includes a spiral groove. A second plate is disposed on the first plate. The second plate includes a first surface and a second surface opposite to the first surface. The second plate is disposed on the first plate. A plurality of clamping posts is disposed on the second plate. Each of the plurality of clamping posts is connected to the spiral groove through the second surface of the second plate, and the plurality of clamping posts is configured to guide and secure a vessel to a center of the first surface of the second plate, by rotating the first and second plates with respect to each other. A content of the vessel is mixed by rotating the first plate, the second plate, and the vessel about their respective centers.

6 Claims, 14 Drawing Sheets

MIXING APPARATUS AND METHOD FOR MIXING FLUID IN A VESSEL

TECHNICAL FIELD

The present invention relates to a mixing apparatus and to a method for mixing fluid in a vessel.

DISCUSSION OF THE RELATED ART

Fluid included in a vessel may be mixed in various ways. The fluid may include gas, liquids and solids. To mix the fluid, the vessel may be placed in an orbit, or an impeller may be submerged in the fluid. When orbiting the vessel at a high rate of speed, a vortex may result inside the vessel. The center of the vortex includes gas. The fluid may be mixed rapidly and efficiently when the vortex is created.

When orbiting a vessel that is sealed and mostly full of liquids and solids, a vortex might not result therein due to the lack of sufficient gas volume in the vessel. Thus, orbiting the vessel will result in a slow and inefficient mixing of the fluid. In addition, an impeller cannot be used to mix the fluid without unsealing the vessel.

SUMMARY

According to an exemplary embodiment of the present invention, a mixing apparatus includes a motor. A first plate is connected to the motor. The first plate includes a spiral groove on a first surface thereof. A second plate is disposed on the first plate. The second plate includes a first surface and a second surface opposite to the first surface. The second surface of the second plate is disposed on the first surface of the first plate. A plurality of clamping posts is disposed on the first surface of the second plate. Each of the plurality of clamping posts is connected to the spiral groove through the second surface of the second plate, and the plurality of clamping posts is configured to guide a vessel to a center of the first surface of the second plate, and to secure the vessel at the center of the first surface of the second plate, by rotating the first and second plates with respect to each other. A content of the vessel is mixed by rotating the first plate, the second plate, and the vessel about their respective centers.

In an exemplary embodiment of the present invention, the spiral groove extends from about a center of the first surface of the first plate toward an outer periphery of the first surface of the first plate in a spiral path. Each of the plurality of clamping posts is connected to a first member, the first member including a protrusion passing through the second surface of the second plate, wherein the protrusion is inserted in the spiral groove. Each of the plurality of clamping posts moves toward the center of the first surface of the second plate or away from the center of the first surface of the second plate when the first and second plates are rotated with respect to each other.

In an exemplary embodiment of the present invention, the mixing apparatus further includes a guard and the second plate further includes a pin. The guard is configured to be moved between a first position and a second position. When disposed at the first position, the guard is coupled with the pin such that the guard prevents the second plate from rotating, and when disposed at the second position, the guard is not coupled with the pin to allow the second plate to rotate.

In an exemplary embodiment of the present invention, when the guard is disposed at the first position, the motor is configured to rotate the first plate in a first direction to move the clamping posts away from the center of the first surface of the second plate, or to rotate the first plate in a second direction opposite to the first direction to move the clamping posts toward the center of the first surface of the second plate.

In an exemplary embodiment of the present invention, when the guard is disposed at the second position, the motor is configured to rotate the first plate, the second plate, and the vessel in a first direction to mix the contents of the vessel.

In an exemplary embodiment of the present invention, at least one of the plurality of clamping posts includes a straight portion.

In an exemplary embodiment of the present invention, a method for mixing contents of a vessel includes inserting a vessel in a mixing apparatus. The vessel is secured using a plurality of clamping posts. The plurality of clamping posts is configured to position the vessel at a center of a first rotating member of the mixing apparatus, and to prevent the vessel from moving away from the center of the first rotating member, by rotating the first rotating member with respect to a second rotating member of the mixing apparatus. Each of the plurality of clamping posts is connected to a spiral groove. The spiral groove is disposed on the second rotating member. A content of the vessel is mixed by rotating the vessel about the center of the vessel.

In an exemplary embodiment of the present invention, the first rotating member is disposed between the second rotating member and the vessel. The spiral groove in disposed on a first surface of the second rotating member. The first rotating member includes a first surface and a second surface opposite to the first surface, and the plurality of clamping posts is disposed on the first surface of the first rotating member. The first surface of the second rotating member is disposed adjacent to the second surface of the first rotating member. Each of the plurality of clamping posts is connected to a protrusion protruding from the second surface of the first rotating member, the protrusion being inserted into the spiral groove of the first rotating member. Securing the vessel includes turning the first rotating member in a first direction with respect to the second rotating member until each of the plurality of clamping posts contacts the vessel.

In an exemplary embodiment of the present invention, mixing the content of the vessel includes simultaneously rotating the first rotating member, the second rotating member and the vessel about their respective centers. Each of the first rotating member, the second rotating member, and the vessel is rotated in the first direction or in a second direction opposite to the first direction.

In an exemplary embodiment of the present invention, the method for mixing contents of a vessel further includes releasing the vessel. Releasing the vessel includes turning the first rotating member in a second direction with respect to the second rotating member, wherein the first and second directions are opposite to each other.

In an exemplary embodiment of the present invention, the mixing apparatus further includes a guard, the guard being configured to move between a first position and a second position. The first rotating member is disposed between the second rotating member and the vessel. The spiral groove is disposed on a first surface of the second rotating member. The first rotating member includes a first surface and a second surface opposite to the first surface, and the plurality of clamping posts is disposed on the first surface of the first rotating member. The first surface of the second rotating member is disposed adjacent to the second surface of the first rotating member. Each of the plurality of clamping posts is connected to a protrusion protruding from the second surface of the first rotating member, the protrusion being inserted into the spiral groove of the first rotating member. Securing the vessel includes disposing the guard into the first position to prevent the first rotating member from rotating, and powering a motor to rotate the second rotating member in a first direction until each of the plurality of clamping posts contacts the vessel.

In an exemplary embodiment of the present invention, mixing the content of the vessel includes disposing the guard into the second position, and simultaneously rotating the first rotating member, the second rotating member and the vessel, about their respective centers, in the first direction or in a second direction opposite to the first direction.

In an exemplary embodiment of the present invention, the method for mixing contents of a vessel further includes releasing the vessel. Releasing the vessel includes disposing the guard into the first position to prevent the first rotating member from rotating, and powering a motor to rotate the second rotating member in a second direction opposite to the first direction.

In an exemplary embodiment of the present invention, a mixing apparatus includes a motor. A first roller is connected to the motor. The motor is configured to rotate the first roller about a center of the first roller. The mixing apparatus includes a plurality of second rollers. Each of the plurality of second rollers is configured to be rotated about its center. The plurality of second rollers are spaced apart from each other and from the first roller. The first roller and the plurality of second rollers are configured to receive a vessel. A content of the vessel is mixed by using the motor to rotate the first roller in a first direction.

In an exemplary embodiment of the present invention, the first roller and the plurality of second rollers are configured to receive a plurality of vessels. A content of each of the plurality of vessels is mixed by using the motor to rotate the first roller in the first direction.

In an exemplary embodiment of the present invention, the first roller is round, and each of the plurality of second rollers is round.

In an exemplary embodiment of the present invention, each of the plurality of second rollers is disposed at a predetermined distance from the first roller.

In an exemplary embodiment of the present invention, the mixing apparatus further includes a plate. The first roller and the plurality of second rollers are disposed on a first surface of the plate. The plate includes a first opening and a second opening. One of the plurality of second rollers is disposed on the first opening and another of the plurality of second rollers is disposed on the second opening. The one of the plurality of second rollers is configured to move along a length of the first opening, and the other of the plurality of second rollers is configured to move along a length of the second opening. The one of the plurality of second rollers is connected to a first spring that pulls the one of the plurality of second rollers toward the first roller, and the other of the plurality of second rollers is connected to a second spring that pulls the other of the plurality of second rollers toward the first roller.

In an exemplary embodiment of the present invention, the first and second springs are disposed on a second surface of the plate. The first and second surfaces of the plate are opposite to each other.

In an exemplary embodiment of the present invention, a method for mixing contents of a vessel includes inserting a vessel in a mixing apparatus. The mixing apparatus includes a first roller and at least two second rollers. The first roller and the at least two second rollers are spaced apart from each other such that the first roller and the at least two second rollers contact the vessel at different positions of an outer surface of the vessel. A content of the vessel is mixed by rotating the first roller. The first roller causes the vessel to rotate about the vessel's center.

In an exemplary embodiment of the present invention, the mixing apparatus includes a first plate, and the first roller and the at least two second rollers are disposed on the first plate. The at least two second rollers are slidably coupled with the first plate. Inserting the vessel in the mixing apparatus includes sliding the at least two second rollers on the first plate to dispose the vessel between the first roller and the at least two second rollers.

BRIEF DESCRIPTION OF THE DRAWINGS

The above and other features and aspects of the present invention will become more apparent by describing in detail exemplary embodiments thereof with reference to the accompanying drawings, in which.

DETAILED DESCRIPTION OF THE EMBODIMENTS

Figure 1:
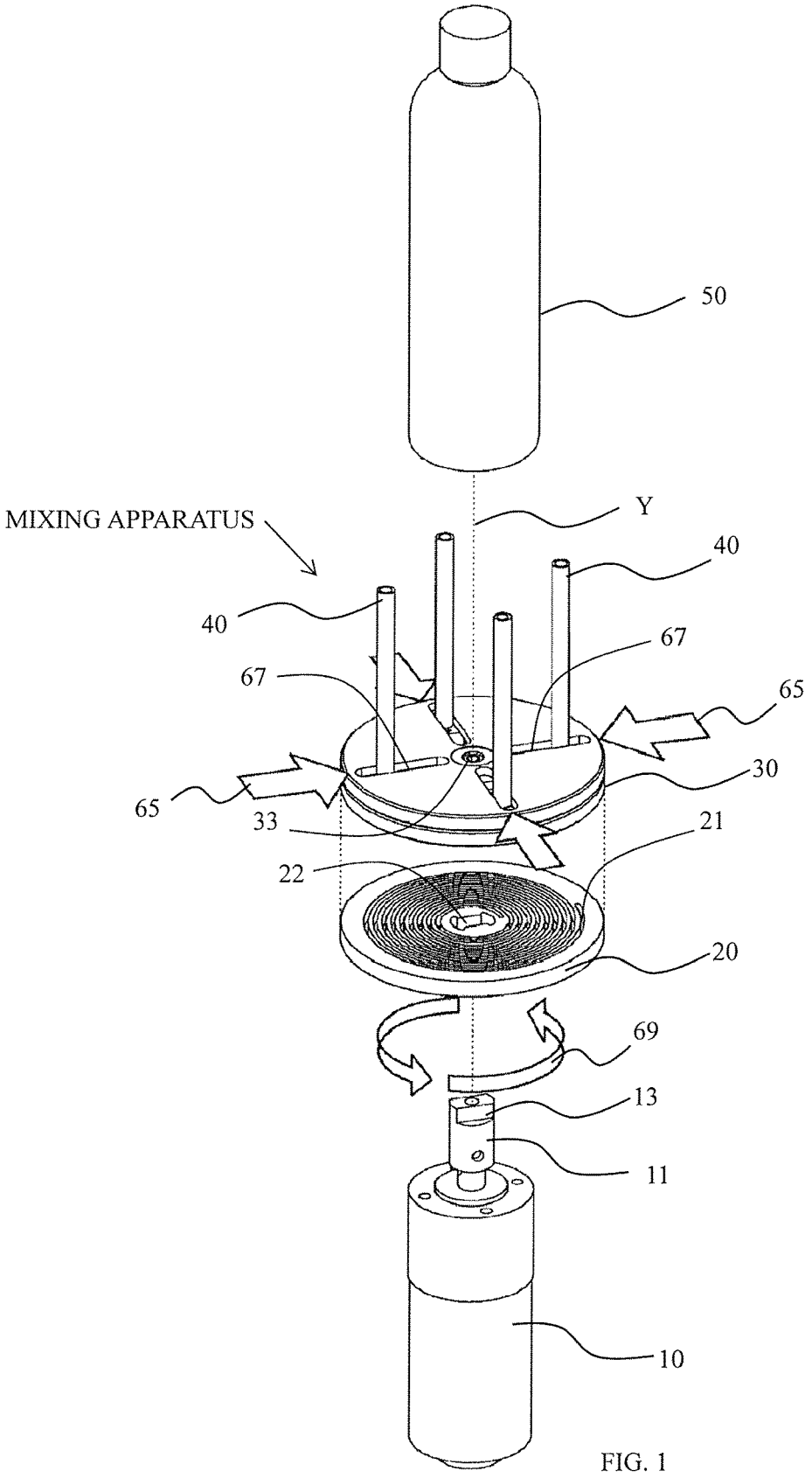
FIG. 1 is an exploded perspective view of a mixing apparatus and a vessel, according to an exemplary embodiment of the present invention.

Exemplary embodiments of the present invention will now be described more fully hereinafter with reference to the accompanying drawings. The present invention may, however, be embodied in different forms and should not be construed as limited to the embodiments set forth herein. In the drawings, the sizes and relative sizes of elements and regions may be exaggerated for clarity.

According to an exemplary embodiment of the present invention, the contents of a vessel that is sealed and mostly full of liquids and solids, (e.g., about 75% to about 95% of the contents inside the vessel are liquids and solids, the remainder being gas) may be efficiently mixed by rotating the vessel about its center.

It will be understood that when an element is referred to as being "on," "connected to" or "coupled to" another element, it can be directly on, connected, or coupled to the other element, or intervening elements may be present.

As used herein, the singular forms "a," "an" and "the" are intended to include the plural forms as well, unless the context clearly indicates otherwise. It will be further understood that terms such as those defined in commonly used dictionaries should be interpreted as having a meaning that is consistent with their meaning in the context of the relevant art and will not be interpreted in an idealized or overly formal sense unless expressly so defined herein.

A mixing apparatus may include a motor, a grooved plate disposed on the motor, and a top plate disposed on the grooved plate. The top plate is configured to receive a vessel and to rotate the vessel about the vessel's center. The top plate includes clamping posts which position the vessel at the center of the top plate. The clamping posts fasten the vessel to the top plate. Each clamping post is connected to a correction member that includes a protrusion, the protrusion being inserted in a spiral groove of the grooved plate. Accordingly, the clamping posts may be moved toward the center of the top plate by rotating the top plate on the grooved plate in a first direction. In addition, the clamping posts may be moved toward an outer periphery of the top plate by rotating the top plate on the spiral grooved plate in a second direction. The first and second directions are opposite to each other.

When the vessel is disposed on the top plate and is fastened to the center of the top plate by the clamping posts, the vessel may be rotated. A vortex may result in the vessel although the vessel is mostly full of liquids and/or solids. Accordingly, the fluid in the vessel may be rapidly and efficiently mixed without unsealing the vessel. In other words, the vessel need not be opened to receive an impeller, and the contents of the vessel need not be poured into a larger vessel, to be efficiently mixed.

Figure 2:
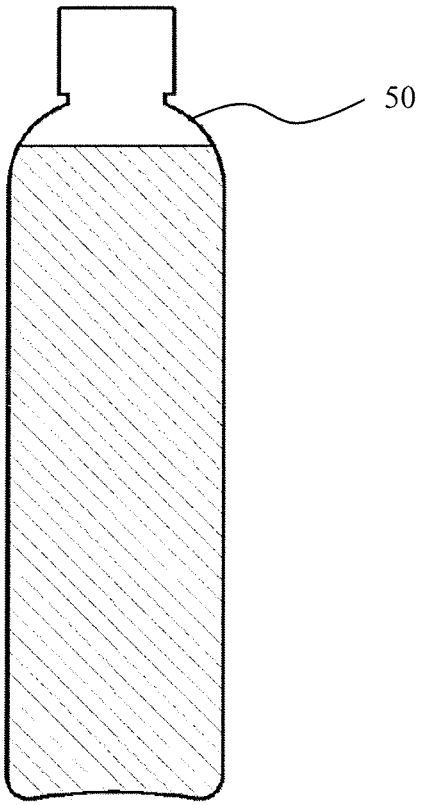
FIG. 2 is a cross-sectional view of the vessel of FIG. 1, according to an exemplary embodiment of the present invention.
Figure 3:
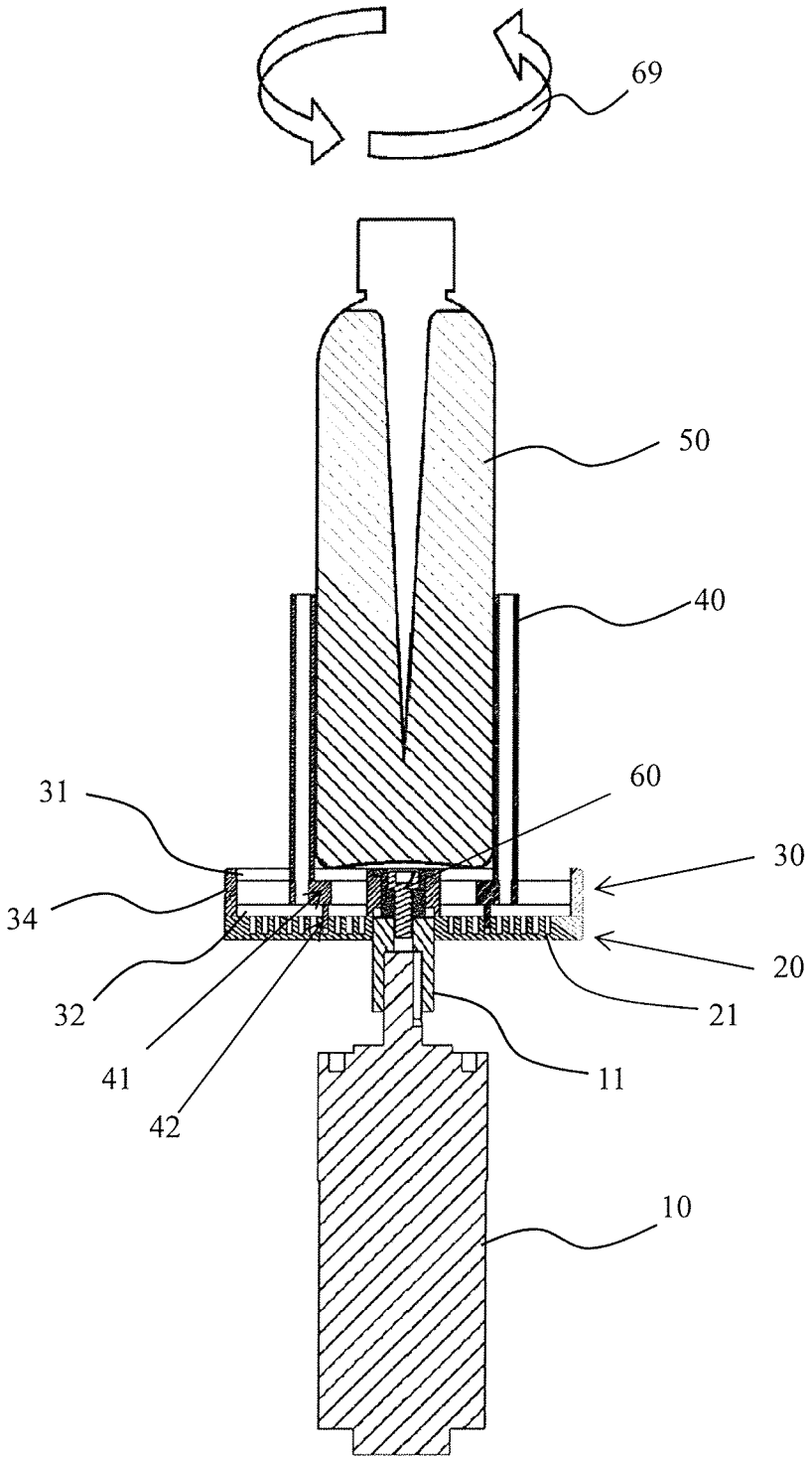
FIG. 3 is a cross-sectional view of the mixing apparatus and the vessel of FIG. 1, according to an exemplary embodiment of the present invention.

FIG. 1 is an exploded perspective view of a mixing apparatus and a vessel, according to an exemplary embodiment of the present invention. FIG. 2 is a cross-sectional view of the vessel of FIG. 1, according to an exemplary embodiment of the present invention. FIG. 3 is a cross-sectional view of the mixing apparatus and the vessel of FIG. 1, according to an exemplary embodiment of the present invention.

Referring to FIGS. 1, 2 and 3, a mixing apparatus includes a motor 10, a grooved plate 20 and a top plate 30. The grooved plate 20 may be disposed on the motor 10. The top plate 30 may be disposed on the grooved plate 20. A vessel 50 may be disposed on the top plate 30. The vessel 50 may be rotated about its center when the motor 10 is powered. In other words, the motor 10 rotates the grooved plate 20, the top plate 30, and the vessel 50.

The motor 10 may include a drive shaft 11. The motor 10 may rotate the drive shaft 11 about a spinning axis Y. The center of the grooved plate 20, the top plate 30, and the vessel 50 may correspond to the spinning axis Y. A first end 13 of the drive shaft 11 may be, for example, circular, polygonal, bar-shaped, plus-sign-shaped, or the like. As shown in FIG. 1, the first end 13 is shaped as a bar and may include a hole in the middle thereof. The hole may extend along the spinning axis Y and may be threaded.

The grooved plate 20 may be circular. The grooved plate 20 may include a spiral groove 21 that is disposed on a first surface of the grooved plate 20. An opening 22 may be disposed in a center of the grooved plate 20. The groove 21 might not overlap with the opening 22. The first end 13 may be configured to be coupled to the opening 22 so the motor 10 may rotate the grooved plate 20. As shown in FIG. 1, the opening 22 and the first end 13 have bar shapes. However, the opening 22 may be, for example, circular, polygonal, bar shaped, plus sign shaped, or the like, to correspond to the shape of the first end 13. Accordingly, the first end 13 may be inserted in the opening 22 so the motor 10 can rotate the plate 20.

The groove 21 may begin at an outer periphery of the opening 22, on the first surface of the grooved plate 20, and extend in a spiral path with respect to a center of the opening 22 toward an outer periphery of the grooved plate 20. The groove 21 may include a plurality of loops around the opening 22.

The top plate 30 may be circular and may include a first surface 31, a second surface 32, and an outer ring 34 connected to outer peripheries of the first and second surfaces 31 and 32. The first and second surfaces 31 and 32 may be separated by a first distance along the spinning axis Y.

The top plate 30 may include an opening 33 at a center thereof. The opening 33 may be an opening at the center of each of the first and second surfaces 31 and 32. In other words, a center of the opening 33 corresponds to the spinning axis Y.

The top plate 30 may have a diameter equal to that of the grooved plate 20. Alternatively, the top plate 30 may have a diameter smaller than, or greater than, that of the grooved plate 20.

According to an exemplary embodiment of the present invention, a screw 60 may be disposed to extend through the opening 33, the opening 22, and the hole of the first end 13 of the drive shaft 11. The screw 60 may fasten the top plate 30 and the grooved plate 20 to the motor 10, for example, by being threaded to the opening 33 and the hole of the first end 13. In this case, the screw 60 is pivotally connected to the top plate 30 to allow the grooved plate 20 and the top plate 30 to rotate against each other. According to an exemplary embodiment of the present invention, the spinning axis Y extends through the center of the drive shaft 11, the grooved plate 20, the top plate 30, and the vessel 50.

The top plate 30 includes a plurality of clamping posts 40. For example, the mixing apparatus of FIG. 1 includes four clamping posts 40. The clamping posts 40 may move radially toward the center of the top plate 30, as shown by the arrows 65, for example, to clamp the vessel 50 to the center of the top plate 30. In other words, the clamping posts 40 surround the vessel 50 and position the center of the vessel 50 at the center of the top plate 30. The vessel 50 may be disposed between the clamping posts 40 and may be in contact with the clamping posts 40. The clamping posts 40 may be spaced apart from each other along the outer circumference of the vessel 50, as shown in FIG. 1. The clamping posts 40 may be, for example, equally distant from each other. The clamping posts 40 may move radially away from the center of the top plate 30, in a direction opposite to that of the arrows 65, for example, to release the vessel 50.

The clamping posts 40 may move along tracks 67 of the first surface 31. The tracks 67 may be linear openings on the first surface 31.

Each clamping post 40 is connected to a corresponding correction member 41. The correction members 41 are disposed between the first and second surfaces 31 and 32 of the top plate 30. The correction members 41 may move radially with respect to the center of the top plate 30, together with the clamping posts 40. Each correction member 41 has a protrusion 42 that is inserted in the groove 21. Since the groove 21 is spiral, each location along the groove 21 is disposed at a slightly different distance from the spinning axis Y (e.g., the center of the top plate 30). Since the vessel 50 may be circular, each clamping post 40 may need to be disposed at an equal distance from the spinning axis Y. Accordingly, each correction member 41 is configured to receive its corresponding clamping post 40 at a different location along a body of the correction member 41 such that all the clamping posts 40 are equally distant to the spinning axis Y.

It is understood that the tracks 67 need not be linear and the clamping posts 40 need not move radially with respect to the center of the top plate 30. The tracks 67 may be curved. The clamping posts 40 may move along the curved tracks 67 as long as the clamping posts 40 move toward the center of the top plate 30 to clamp the vessel 50, and away from the center of the top plate 30 to release the vessel 50.

To clamp the vessel 50 with the clamping posts 40, the grooved plate 20 may be held stationary, and the top plate 30 may be rotated in a first direction (e.g., clockwise) on the grooved plate 20. To release the vessel 50 from the clamping posts 40, the grooved plate 20 may be held stationary, and the top plate 30 may be rotated in a second direction (e.g., counter-clockwise) on the grooved plate 20. The first and second directions of rotation are opposite to each other. The second direction is shown in FIGS. 1 and 3 by the two curved arrows 69.

Alternatively, to clamp the vessel 50 with the clamping posts 40, the grooved plate 20 may be rotated in the second direction, and the top plate 30 may be held stationary. In this case, the grooved plate 20 may be rotated in the first direction, and the top plate 30 may be held stationary, to release the vessel 50.

However, it is understood that both grooved and top plates 20 and 30 may be simultaneously rotated in different directions with respect to each other to clamp or release the vessel 50 with the clamping posts 40.

Referring to FIGS. 1 to 3, the clamping posts 40 are straight and the vessel 50 is cylindrical. Thus, the clamping posts 40 may securely clamp the vessel 50. However, the vessel 50 may be curved or have edges. For example, the vessel 50 may be spherical, or it may be shaped like a vase, a bowl, and the like. In addition, the vessel 50 may be shaped as cone, cube, pyramid, and the like. It is understood that the vessel 50 is sealed.

The clamping posts 40 may be curved or bent according to the shape of the vessel 50 to securely clamp the vessel 50.

When the vessel 50 is clamped on the top plate 30, the motor 10 may be powered to rotate the vessel 50 about the center of the vessel 50. The motor 10 may rotate the vessel 50, for example, in the second direction, as illustrated by the two curved arrows 69 in FIGS. 1 and 3. However, the motor 10 may also rotate the vessel 50 in the first direction.

An additional clamping device might not be needed to prevent the grooved plate 20 and the top plate 30 from rotating against each other when using the motor 10 to rotate the vessel 50. The grooved and top plates 20 and 30 may be prevented from rotating with respect to one another by friction forces between the protrusions 42 and the groove 21. However, an external clamping device may also be used, when desired, to prevent the grooved and top plates 20 and 30 from rotating with respect to one another. Accordingly, the clamping posts 40 may remain clamped to the vessel 50 while the vessel 50 is being rotated.

It is understood that the center of the vessel 50 may correspond to the center of the top plate 30 and to the spinning axis Y. When the vessel 50 is rotated about its center, the liquids and/or solids included therein may be efficiently mixed, although the liquids and/or solids occupy about 75% to about 95% of the volume of the vessel 50. In addition, even when the liquids and/or solids occupy about 75% to about 95% of the volume of the vessel 50, a vortex may be created inside the vessel 50, as shown in FIG. 3, when the motor 10 rotates the vessel 50. Thus, the fluid in the vessel 50 may be rapidly and efficiently mixed without unsealing the vessel 50. In other words, the vessel 50 need not be opened to receive an impeller, and the contents of the vessel 50 need not be poured into a larger vessel to be efficiently mixed.

Figure 4:
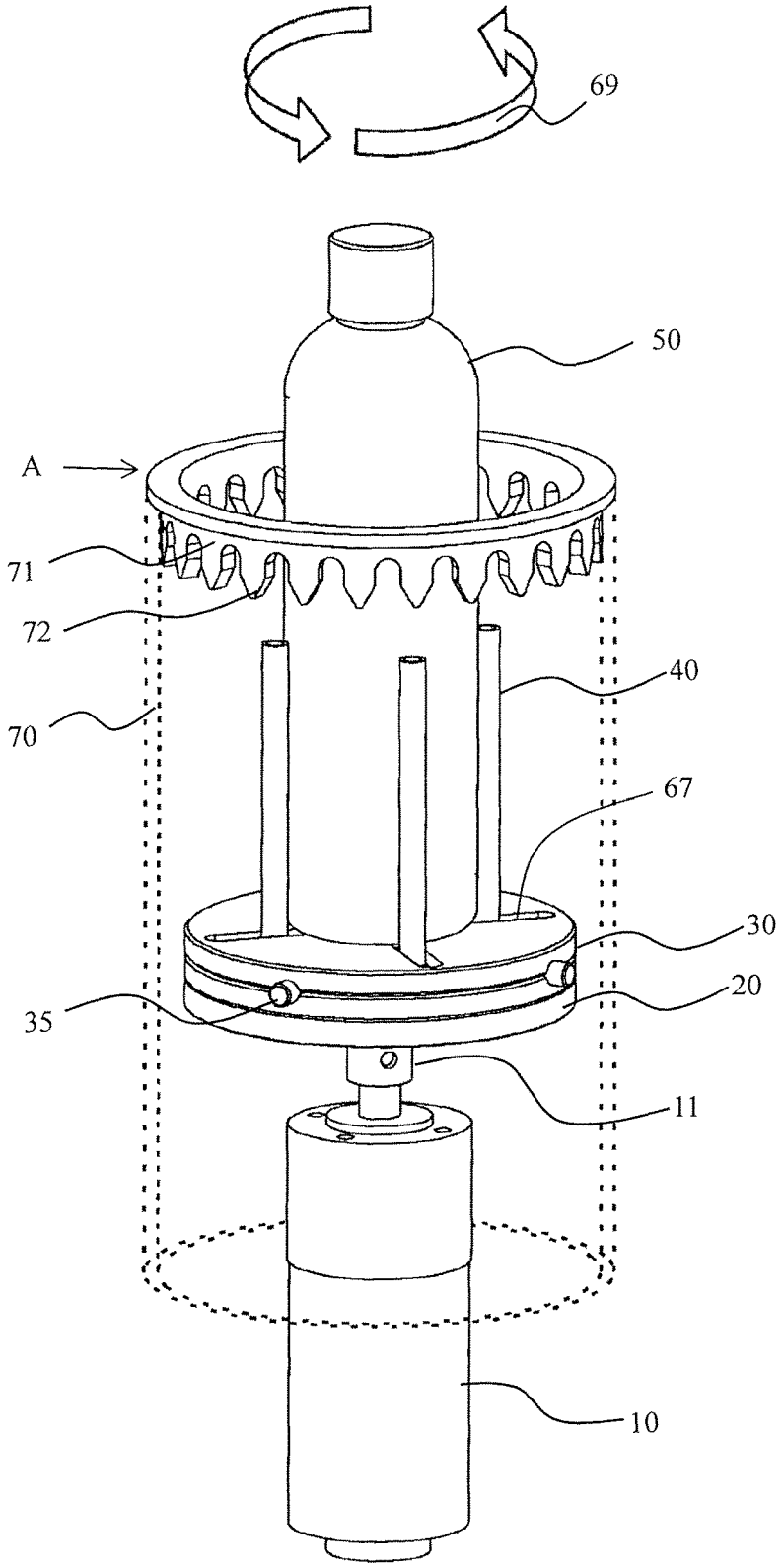
FIG. 4 is a perspective view of a mixing apparatus and a vessel, according to an exemplary embodiment of the present invention.
Figure 5:
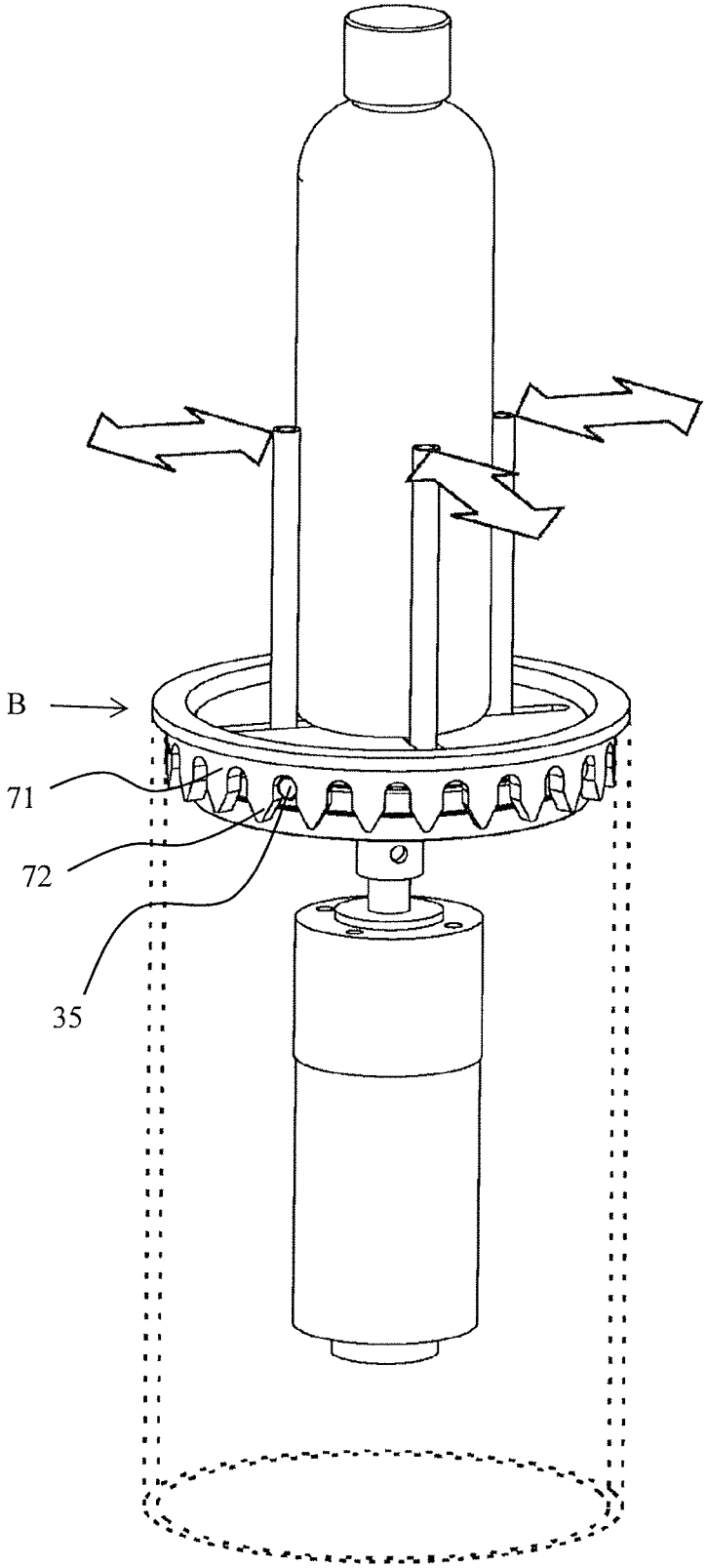
FIG. 5 is a perspective view of the mixing apparatus and a vessel of FIG. 4, according to an exemplary embodiment of the present invention.

FIG. 4 is a perspective view of a mixing apparatus and a vessel, according to an exemplary embodiment of the present invention. FIG. 5 is a perspective view of the mixing apparatus and a vessel of FIG. 4, according to an exemplary embodiment of the present invention.

Various elements of the mixing apparatus of FIG. 4 are similar to those of the mixing apparatus of FIG. 1. Accordingly, a duplicate description thereof may be omitted for brevity.

The mixing apparatus of claim 1 includes the motor 10, the grooved plate 20, the top plate 30, and a guard 70.

Referring to FIG. 4, the top plate 30 includes at least one locking pin 35. The top plate 30 of FIG. 4 includes a plurality of locking pins 30. The locking pins 30 may be pins, cylinders, or protrusions, disposed on an outer periphery of the top plate 30. The locking pins 30 may be disposed, for example, on the outer ring 34.

The guard 70 may be a hollow member having a first open end and a second open end opposite to the first open end. The motor 10, the grooved plate 20, and the top plate 30 may be disposed inside the guard 70. For example, the guard 70 may be a hollow cylinder, and the motor 10, the grooved plate 20, and the top plate 30 may be disposed in the hollow portion of the cylinder.

The first open end of the guard 70 may include a locking ring 71. The locking ring 71 may have gear teeth/protrusions 72 that correspond to the locking pins 35. For example, the locking ring 71 may be coupled with the locking pins 35.

Referring to FIGS. 4 and 5 the guard 70 may be located in position A on in position B. The guard 70 may slide, or move, between position A and position B. However, the guard 70 might not rotate about its own center. For example, in an exemplary embodiment of the present invention, the guard 70 can be moved up and down between position A and position B, but the guard 70 cannot be rotated. In an exemplary embodiment of the present invention, the guard 70 does not rotate in the first direction and it does not rotate in the second direction.

Referring to FIG. 4, when the guard 70 is located in position A, the locking ring 71 is not engaged with the locking pins 35. In addition, the guard 70 covers, or overlaps, a large portion of the vessel 50. The clamping posts 40 may be clamping the vessel 50. In this case, the motor 10 may be powered to rotate the vessel 50 about the center of the vessel 50. The grooved and top plates 20 and 30 may overlap and guard 70 and rotate inside the guard 70. The portion of the guard 70 that overlaps the vessel 50 acts as a guard to prevent external objects from coming into contact with the rotating parts of the mixing apparatus, or to prevent injury to a user from parts or particles ejected from the mixing apparatus while the motor 10 is rotating the vessel 50.

Referring to FIG. 5, the guard 70 is in position B. In position B, the locking ring 71 is coupled with the locking pins 35. In addition, the first surface 31 of the top plate 30 and the clamping posts 40 are exposed to a user. In this state, the user may power the motor 10 to rotate the drive shaft 11 and the grooved plate 20 in the first or second directions.

For example, the user may use the motor 10 to rotate the grooved plate 20 in the first direction to clamp the vessel 50 with the clamping posts 40. This occurs because the guard 70, which does not rotate, holds the top plate 30 stationary while allowing the grooved plate 20 to rotate. In addition, the user may use the motor 10 to rotate the grooved plate 20 in the second direction to release the vessel 50 from the clamping posts 40. Thus, by using the guard 70 to maintain the top plate 30 stationary, the clamping posts 40 may be moved closer to, or farther from, the center of the top plate 30 by using the motor 10 to rotate the grooved plate 10 in the first or second direction.

Figure 6:
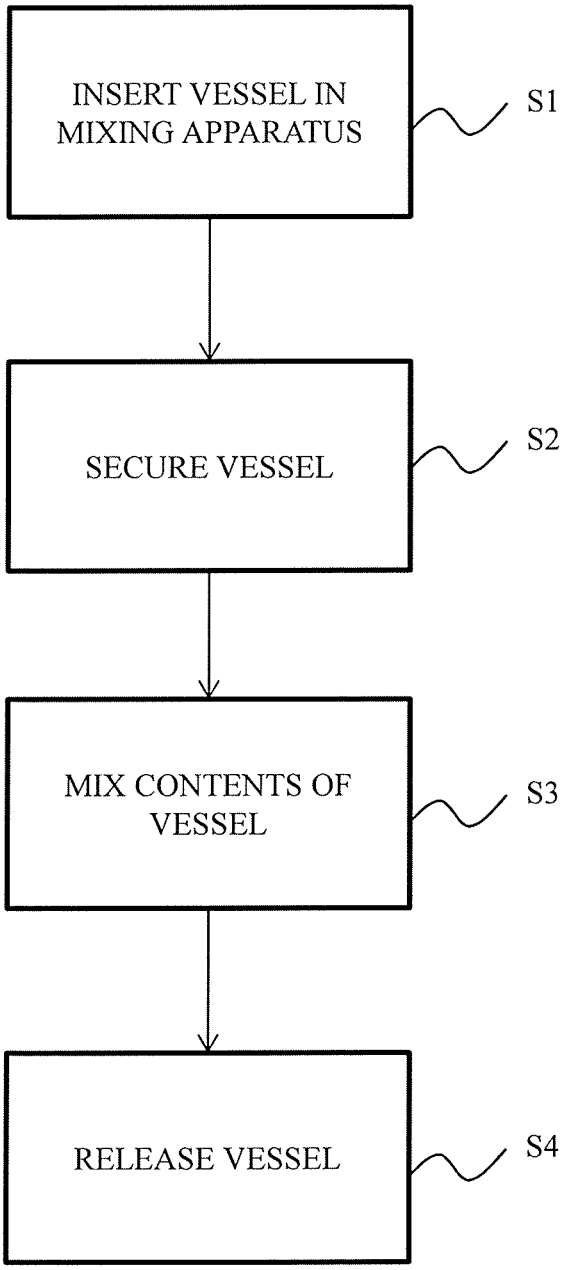
FIG. 6 is a diagram illustrating a method for mixing contents of a vessel, according to an exemplary embodiment of the present invention.

FIG. 6 is a diagram illustrating a method for mixing contents of a vessel, according to an exemplary embodiment of the present invention. The mixing apparatus used in the method of FIG. 6 may be the mixing apparatus of FIGS. 1 and 3, or the mixing apparatus of FIGS. 4 and 5.

Referring to FIG. 6, Step S1 includes inserting a vessel 50 in a mixing apparatus. Step S1 may include moving the clamping posts 40 away from the center of the top plate 30 to make space for the vessel 50. This may be done manually, (e.g., by hand) by rotating the grooved and top plates 20 and 30 with respect to one another, when using the apparatus of FIGS. 1 and 3. However, this may also be done by setting the guard 70 in position B, and using the motor 10 to rotate the grooved plate 20, as shown in FIG. 4.

The vessel 50 may then be disposed on the first surface 31 of the top plate 30, between the clamping posts 40.

Step S2 includes securing the vessel 50 on the top plate 30. For example, when using the mixing apparatus of FIGS. 1 and 3, the vessel 50 may be secured by manually rotating the grooved and top plates 20 and 30 with respect to one another. The direction in which the grooved and top plates 20 and 30 are rotated in Step S2 to clamp the vessel 50 is opposite to that of Step S1, used to make space for the vessel 50.

When using the mixing apparatus of FIGS. 4 and 5, the motor 10 may be used to rotate the grooved plate 20 in a direction opposite to that used to make space for the vessel 50 in Step S1. Accordingly, the vessel 50 may be securely clamped by the clamping posts 40.

Step S3 includes mixing the contents of the vessel 50 by using the motor 10 to rotate the grooved and top plates 20 and 30, the clamping posts 40, and the vessel 50 about the center of the vessel 50. When using the mixing apparatus of FIGS. 1 and 3, Step S3 may include powering the motor 10 to rotate the vessel 50 about the center of the vessel 50. The motor 10 may rotate the vessel 50 in the first direction, or in the second direction, as shown by the two curved arrows 69. When using the mixing apparatus of FIGS. 4 and 5, Step S3 may include raising, or moving, the guard 70 into position A, and then powering the motor 10 to rotate the vessel 50 in the first or second direction.

In Step S3, the contents of the vessel 50 (e.g., liquids, solids, and gas) may be efficiently mixed even when the liquids and/or solids occupy about 75% to about 95% of the volume of the vessel 50. In Step S3 the contents of the vessel 50 may be in a state similar to that shown in FIG. 3, when the liquids and/or solids occupy about 75% to about 95% of the volume of the vessel 50.

It is understood that the contents of the vessel 50 may appear as shown in FIG. 3 whether the mixing apparatus of FIGS. 1 and 3, or that of FIGS. 4 and 5, is used in Step S3.

Step S3 may include stopping the motor 10 from rotating the vessel 50 after a predetermined amount of time.

Step S4 includes releasing the vessel 50 from the mixing apparatus. When using the mixing apparatus of FIGS. 1 and 3, the vessel 50 may be released by manually rotating the grooved and top plates 20 and 30 with respect to one another. This procedure may be similar to that of moving the clamping posts 40 away from the center of the top plate 30 to make space for the vessel 50, as described in Step S1.

In Step S4, when using the mixing apparatus of FIGS. 4 and 5, the guard 70 may be lowered, or moved, into position B. When the guard is lowered into position B, the motor 10 may be used to turn the grooved plate 20 to release the vessel 50 by causing the clamping posts 40 to move away from the center of the top plate 30. This procedure may be similar to that of moving the clamping posts 40 away from the center of the top plate 30 to make space for the vessel 50, as described in Step S1.

Figure 7:
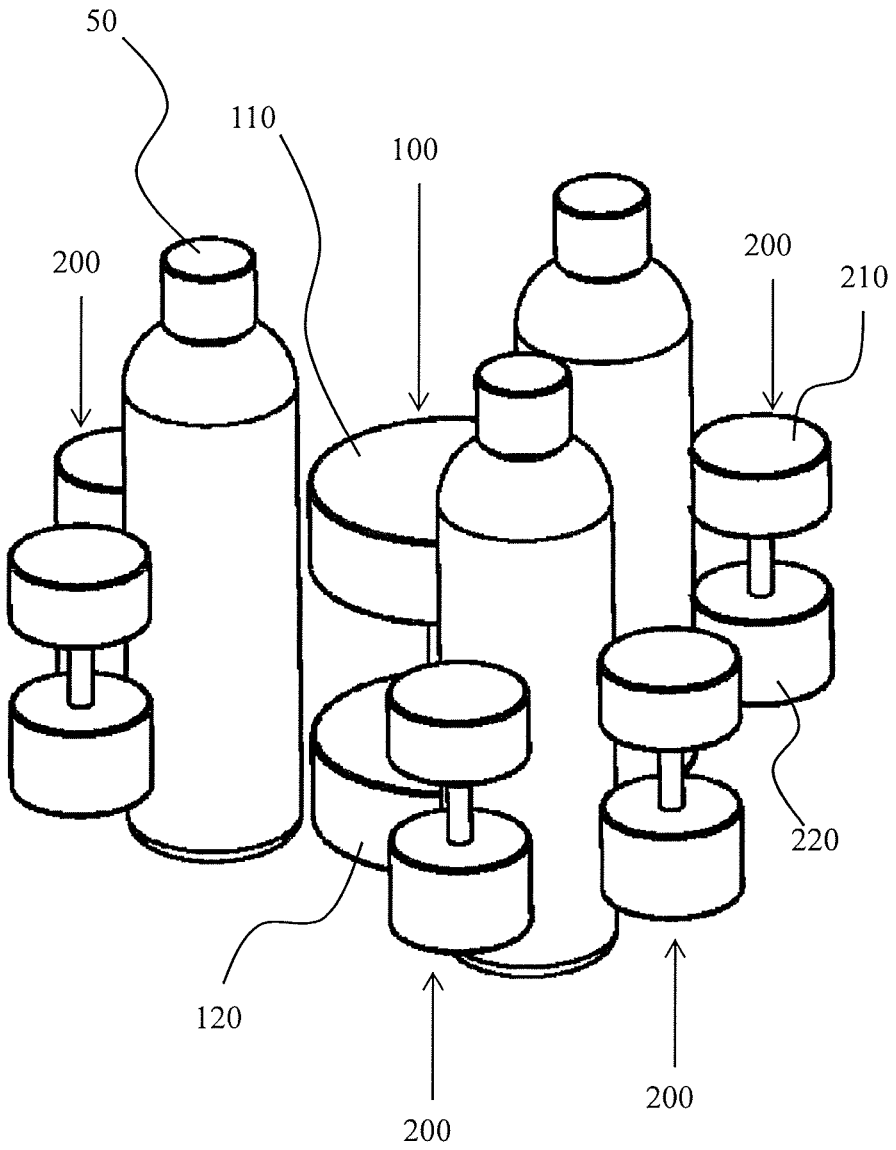
FIG. 7 is a perspective view of a mixing apparatus, according to an exemplary embodiment of the present invention.
Figure 8:
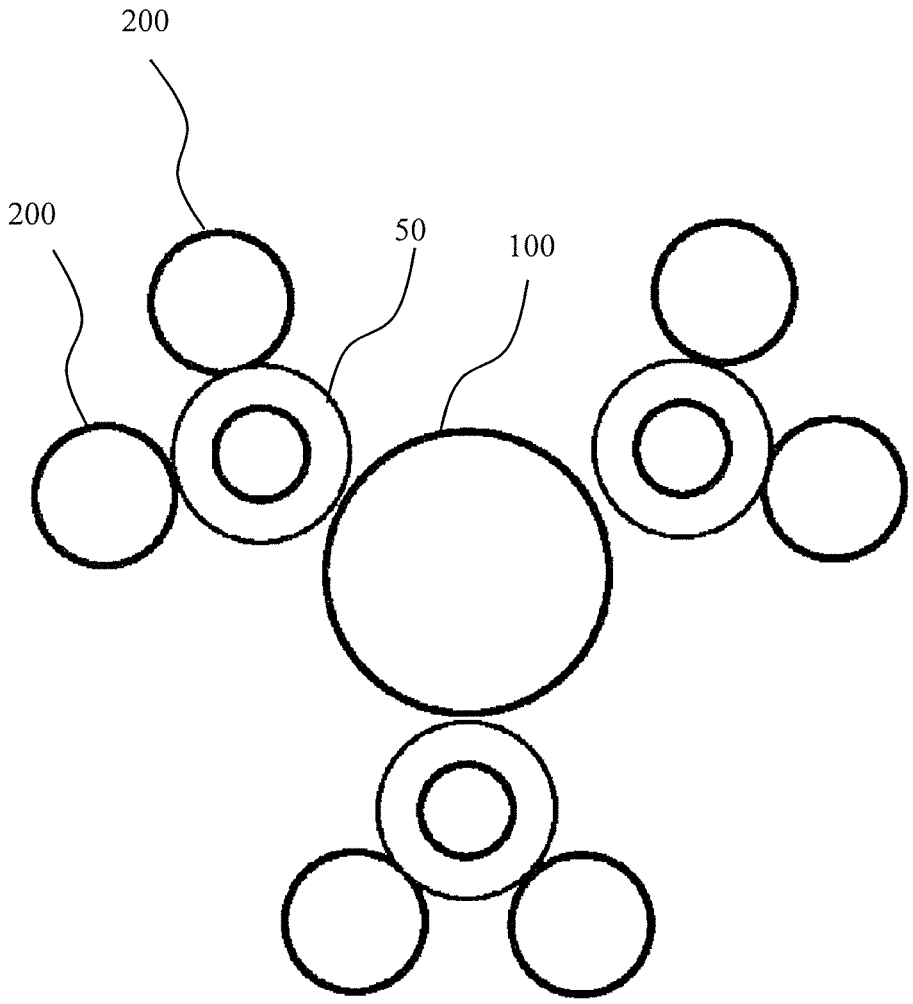
FIG. 8 is a top plan view of the mixing apparatus of FIG. 7, according to an exemplary embodiment of the present invention.
Figure 9:
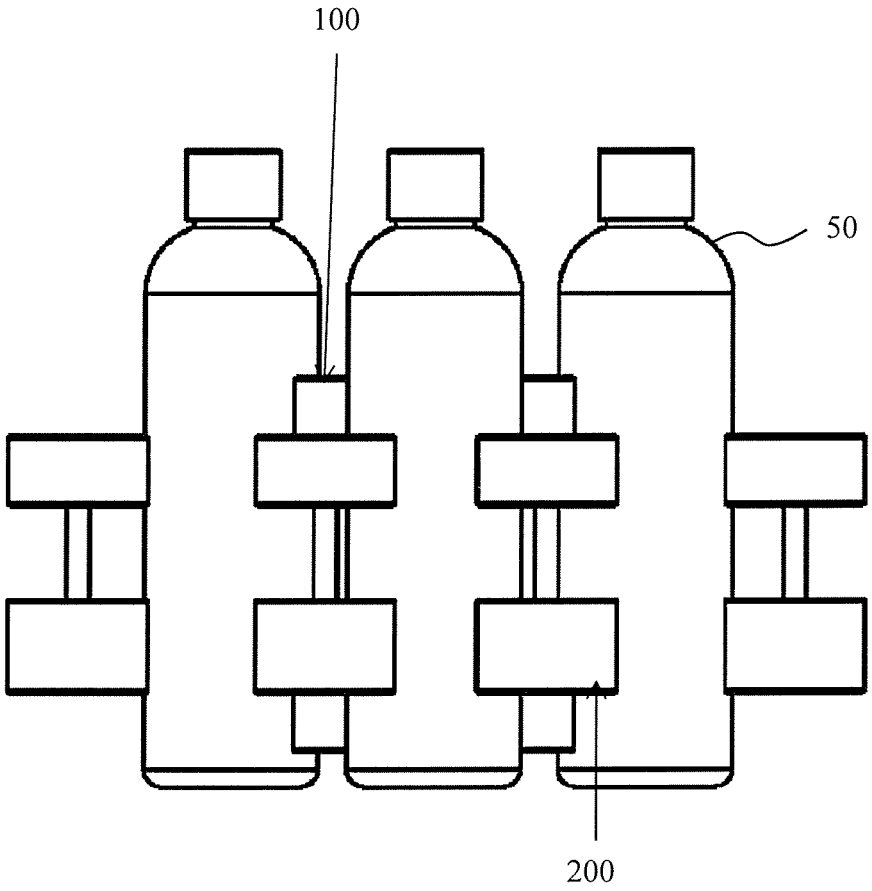
FIG. 9 is a side view of the mixing apparatus of FIG. 7, according to an exemplary embodiment of the present invention.

FIG. 7 is a perspective view of a mixing apparatus, according to an exemplary embodiment of the present invention. FIG. 8 is a top plan view of the mixing apparatus of FIG. 7, according to an exemplary embodiment of the present invention. FIG. 9 is a side view of the mixing apparatus of FIG. 7, according to an exemplary embodiment of the present invention.

Referring to FIGS. 7 to 9, a mixing apparatus includes a drive roller 100 and a pair of idler rollers 200. A vessel 50 may be disposed between the pair of idler rollers 200 and the driver roller 100. The vessel 50 may be in direct contact with the drive roller 100 and the pair of idler rollers 200.

According to an exemplary embodiment of the present invention, the spinning axis Y passes through a center of the drive roller 100. Thus, the drive roller 100 rotates about its own center and about the spinning axis Y. A motor, for example, the motor 10, may be used to rotate the drive roller 100 about the spinning axis Y.

The drive roller 100 may include a top cylinder 110, a bottom cylinder 120, and a shaft connecting the top and bottom cylinders 110 and 120. The top and bottom cylinders 110 and 120 may contact the vessel 50. Alternatively, the drive roller 110 may be one cylinder or disk that rotates about its center. In addition, the center of the cylinder or disk is positioned at the spinning axis Y. The drive roller 110 may be coated with rubber, plastic, or other material having a high friction coefficient. A length of the driver roller 100, along the spinning axis Y, may be varied according to a length of the vessel 50.

The pair of idler rollers 200 may be similar in shape to the drive roller 100. For example, each of the pair of idler rollers 200 may include a top cylinder 210, a bottom cylinder 220, and a shaft connecting the top and bottom cylinders 210 and 210. Each of the pair of idler rollers 200 rotates about its own center. In addition, a vertical axis that passes through the center of each idler roller 200 may be parallel to the spinning axis Y. Thus, each of the pair of idler rollers 200 rotates about its own vertical axis. Alternatively, each of the pair of idler rollers 200 may be one cylinder or disk that rotates about its own center.

One idler roller 200 does not contact another idler roller 200. The pair of idler rollers 200 may be smaller than, equal to, or greater in size than the drive roller 100. For example, a diameter of each of the top and bottom cylinders 210 and 220 may be smaller than that of the top and bottom cylinders 110 and 120, respectively. However, according to an exemplary embodiment of the present invention, the diameter of each of the top and bottom cylinders 210 and 220 may be equal to or greater than that of the top and bottom cylinders 110 and 120, respectively. In addition, the top and bottom cylinders 210 and 220 may have diameters of different sizes. The distance between the top and bottom cylinders 210 and 220 of each of the pair of idler rollers 200 may be varied according to the length of the vessel 50. The pair of idler rollers 200 may press the vessel 50 on the drive roller 100. Alternatively, the pair of idler rollers 200 are fixed in place, and are in contact with the vessel 50, the vessel 50 being in contact with the drive roller 100. In this case, the vessel 50 may be snuggly fit between the pair of idler rollers 200 and the drive roller 100.

When the drive roller 100 rotates, it causes the vessel 50 to rotate. The vessel 50 rotates about its own center. The vessel 50, being rotated by the drive roller 100, rotates each of the pair of idler rollers 200. Thus, the drive roller 100, the vessel 50, and each of the pair of the idler rollers 200 rotate about their respective centers. A vortex may result in the vessel 50 when the vessel 50 is rotated between the drive roller 100 and the pair of idler rollers 200 although the vessel 50 may be mostly full of liquids and/or solids. Accordingly, the fluid in the vessel 50 may be rapidly and efficiently mixed without unsealing the vessel. In other words, the vessel 50 need not be opened to receive an impeller, and the contents of the vessel 50 need not be poured into a larger vessel to be efficiently mixed.

As shown in FIGS. 7-9 a plurality of vessels 50 may be rotated by one drive roller 100. Each of the plurality of vessels 50 may be in contact with a pair of idler rollers 200 and the drive roller 100.

According to an exemplary embodiment of the present invention, the pair of idler rollers 200 are rigidly fixed and do not move with respect to each other or with respect to the drive roller 100. In this case, the mixing apparatus may be used to mix one or more vessels 50 of predetermined sizes and shapes, depending on the distance between the drive roller and the fixed-in-place idler rollers 200.

According to an exemplary embodiment of the present invention, the pair of idler rollers 200 may be moved with respect to the drive roller 100 and with respect to each other. In this case, the mixing apparatus may be used to mix one or more vessels 50 of a various sizes and shapes.

According to an exemplary embodiment of the present invention, each of the vessels 50 may be disposed on a surface having a low friction coefficient, for example, acetal.

Figure 10:
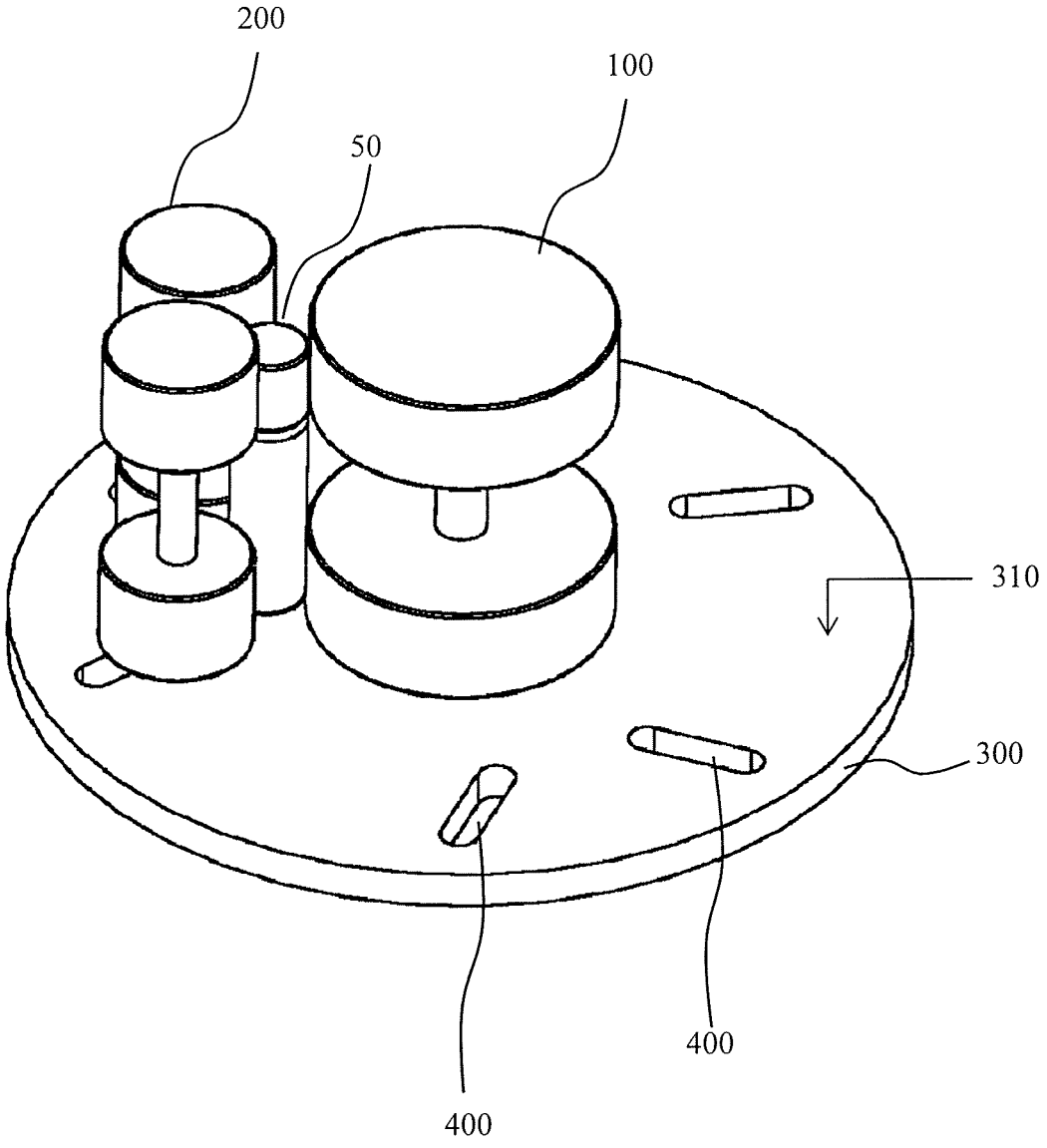
FIG. 10 is a top perspective view of a mixing apparatus, according to an exemplary embodiment of the present invention.
Figure 11:
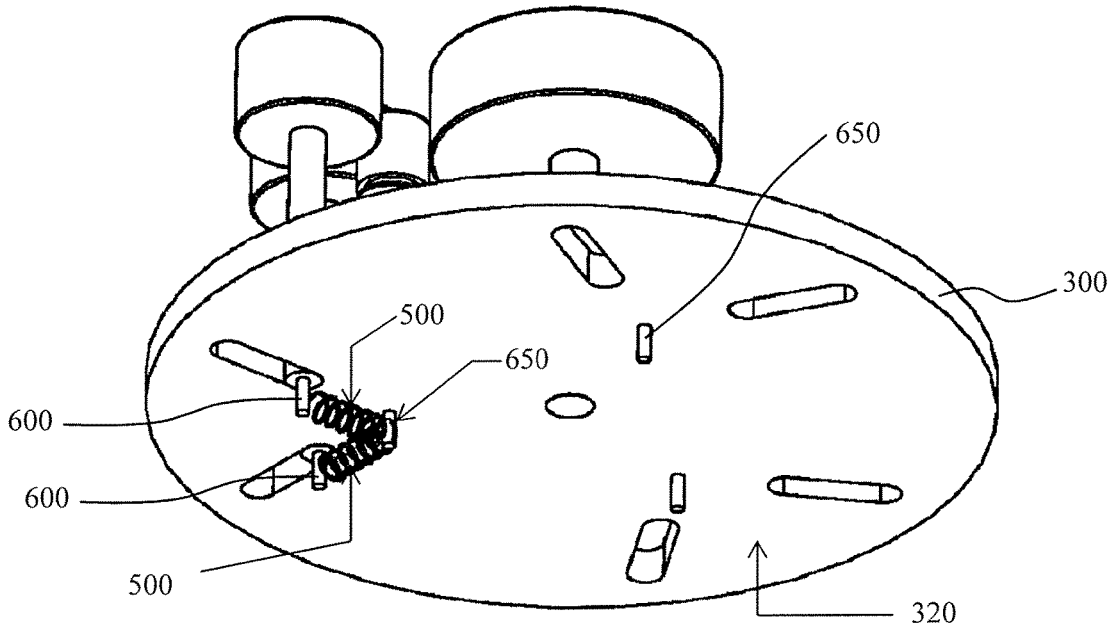
FIG. 11 is a bottom perspective view of the mixing apparatus of FIG. 10, according to an exemplary embodiment of the present invention.

FIG. 10 is a top perspective view of a mixing apparatus, according to an exemplary embodiment of the present invention. FIG. 11 is a bottom perspective view of the mixing apparatus of FIG. 10, according to an exemplary embodiment of the present invention.

Referring to FIGS. 10 and 11, a mixing apparatus includes a support plate 300, a drive roller 100, and a pair of idler rollers 200. The drive roller 100 may be disposed on the support plate 300. The support plate 300 includes a top surface 310 and a bottom surface 320. The pair of idler rollers 200 is disposed on the top surface 310. The top surface 310 may have a low friction coefficient. For example, the top surface 310 may include acetal.

The support plate 300 includes a pair of tracks 400. Each of the pair of tracks 400 is an opening in the support plate 300, extending, for example, linearly. Each of the pair of idler rollers 200 may be configured to slide, or move, on a corresponding track 400. For example, each of the idler rollers 200 includes an extension part inserted in its corresponding track 400. The extension part includes a protruding part 600 which protrudes beyond the bottom surface 320, in a direction away from the bottom surface 320.

The pair of tracks 400 may be angled with respect to each other, as shown in FIG. 11. Each of the pair of tracks 400 may be angled, for example, at 120° with respect to each other. Extension springs 500 may be connected to a protruding part 650 and a protruding part 600. As shown in FIGS. 10 and 11, a pair of extension springs 500 may connect the pair of rollers 200 with one protruding part 650. Accordingly, when a vessel 50 is disposed between the pair of idler rollers 200 and the drive roller 100, the extension springs 500 cause the vessel 50 to be in contact with the drive roller 100 and the pair of idler rollers 200. In other words, the extension springs 500 maintain compression between the idler rollers 200, the vessel 50, and the drive roller 100.

Figure 12:
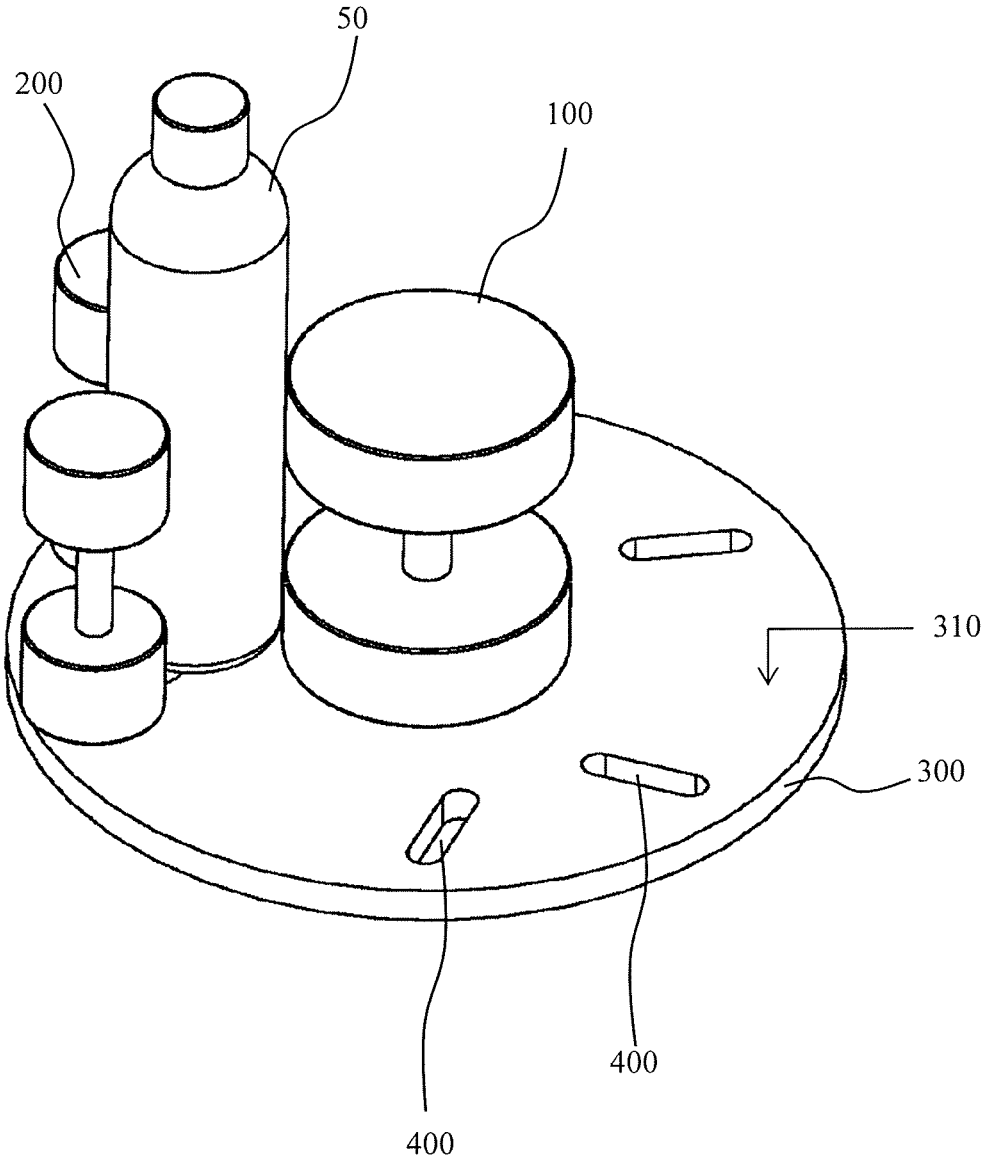
FIG. 12 is a top perspective view of a mixing apparatus, according to an exemplary embodiment of the present invention.
Figure 13:
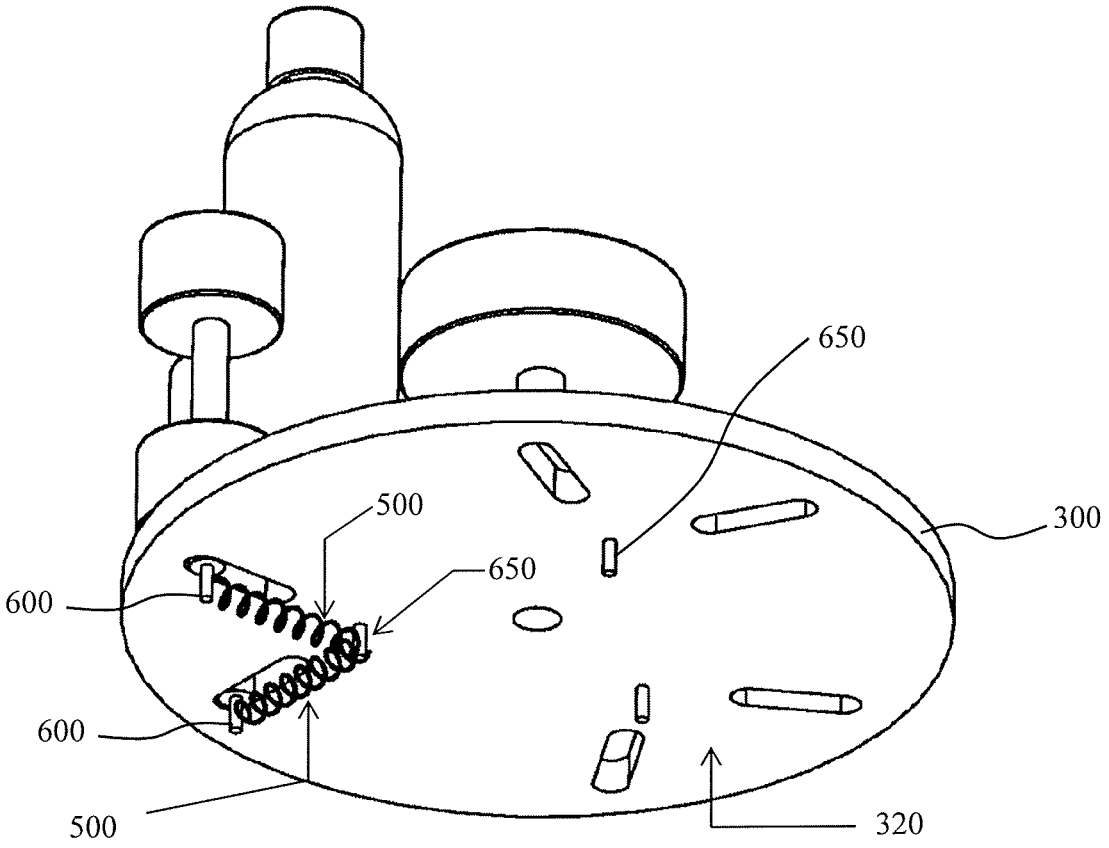
FIG. 13 is a bottom perspective view of the mixing apparatus of FIG. 12, according to an exemplary embodiment of the present invention.

FIG. 12 is a top perspective view of a mixing apparatus, according to an exemplary embodiment of the present invention. FIG. 13 is a bottom perspective view of the mixing apparatus of FIG. 12, according to an exemplary embodiment of the present invention.

The pair of idler rollers 200 may be moved along the tracks 400 to fit vessels 50 of different sizes and shapes. As can be seen by comparing FIGS. 10 and 11 with FIGS. 12 and 13, in FIGS. 12 and 13 the idler rollers 200 have moved along the tracks 400 and are disposed further away from the drive roller 100 to receive a vessel 50 with a larger diameter than that of the vessel 50 of FIGS. 10 and 11. The extension springs 50 ensure that contact is maintained between the larger diameter vessel 50, the pair of idler rollers 200 and the drive roller 100. The extension springs 50 cause the pair of idler rollers 50 to apply sufficient pressure on the vessel 50 to maintain stability of the vessel 50 during rotation thereof.

The mixing apparatus of FIGS. 10 to 13 may include more than one pair of idler rollers 200. For example, three pairs of idler rollers 200 and three vessels 50 may be disposed on the support plate 300. Each of the vessels 50 may be in contact with a respective pair of idler rollers 200 and the drive roller 100. Each of the pair of idler rollers 200 may compress its respective vessel 50 against the drive roller 100. Accordingly, when the drive roller 100 is rotated, the three vessels 50 may be simultaneously rotated. Thus, the contents of a plurality of vessels 50 may be simultaneously mixed using the mixing apparatus of FIGS. 7 to 9, and FIGS. 10 to 13. Each of the vessels 50 may be mostly full, as described above. Accordingly, the fluid in each of the vessels 50 may be rapidly and efficiently mixed without unsealing the vessels 50. In other words, the vessels 50 need not be opened to receive an impeller, and the contents of the vessels 50 need not be poured into larger vessels to be efficiently mixed.

Figure 14:
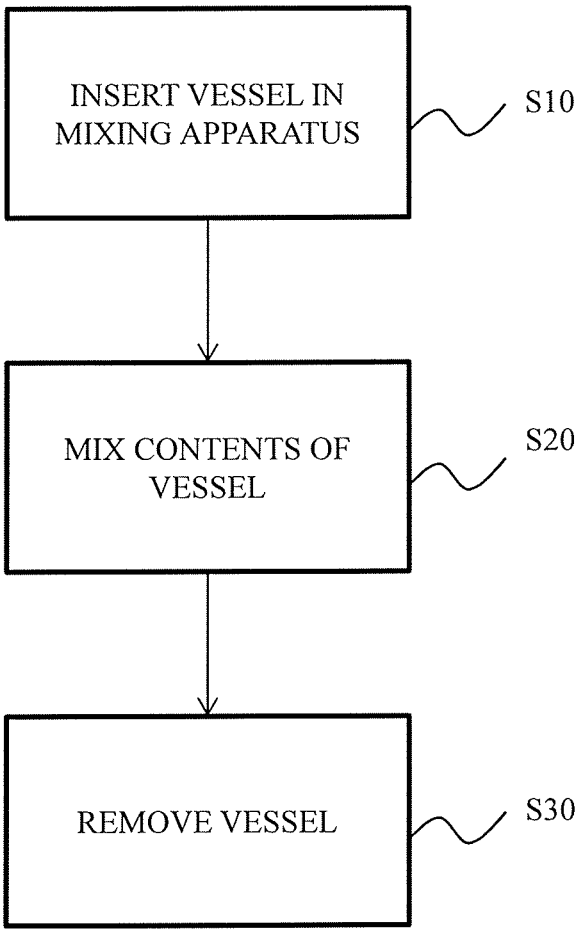
FIG. 14 is a diagram illustrating a method for mixing contents of a vessel, according to an exemplary embodiment of the present invention.

FIG. 14 is a diagram illustrating a method for mixing contents of a vessel, according to an exemplary embodiment of the present invention. More particularly, FIG. 14 is a diagram illustrating a method for mixing contents of a vessel using the mixing apparatus of FIGS. 10 to 13, according to an exemplary embodiment of the present invention.

Referring to FIG. 14, Step S10 includes inserting a vessel 50 into the mixing apparatus of FIGS. 10-13. The vessel 50 may be slid between the pair of idler rollers 200 and the drive roller 100, depending on the size and shape of the vessel 50. Alternatively, the pair of idler rollers 200 may be moved back into the tracks 400 to make space for the vessel 50 to be inserted between the pair of idler rollers 200 and the drive roller 100. The pair of idler rollers 200 may be moved away from the drive roller 100 by hand (e.g., manually), or by using a mechanical or motorized device. The vessel 50 may be disposed on the top surface 310 of the support plate 300.

In addition, Step S10 may include inserting a plurality of vessels 50 between corresponding pairs of idler rollers 200 and the drive roller 100.

Step S20 includes mixing the contents of the vessel 50 by powering the motor 10. The motor 10 rotates the drive roller 100. The drive roller 100 rotates the one or more vessels 50 about their respective centers. Thus, even when the liquids and/or solids occupy about 75% to about 95% of the volume of each of the one or more vessels 50, a vortex may be created inside each of the one or more vessels 50, as shown in FIG. 3. Accordingly, the fluid in each of the one or more vessels 50 may be rapidly and efficiently mixed without unsealing the vessels 50.

Step S20 may include stopping the motor 10 from rotating the one or more vessels 50 after a predetermined amount of time.

Step S30 includes removing the one or more vessels 50 from the mixing apparatus. The one or more vessels 50 may be removed by sliding them away from the idler rollers 200 and the drive roller 100. Alternatively, each of the pairs of rollers 200 may be pulled away from the vessel 50 and the drive roller 100 to release the vessel 50. This may be done manually or by using a mechanical or motorized device.

While the present invention has been particularly shown and described with reference to exemplary embodiments thereof, it will be apparent to those of ordinary skill in the art that various changes in form and detail may be made therein without departing from the spirit and scope of the invention as defined by the following claims.

What is claimed is:

1. A mixing apparatus, comprising:

a motor;

a first plate connected to the motor, wherein the first plate includes a spiral groove on a first surface thereof;

a second plate disposed on the first plate, wherein the second plate includes a first surface and a second surface opposite to the first surface, wherein the second surface of the second plate is disposed on the first surface of the first plate; and a plurality of clamping posts disposed on the first surface of the second plate, wherein each of the plurality of clamping posts is connected to the spiral groove through the second surface of the second plate, and the plurality of clamping posts is configured to guide a vessel to a center of the first surface of the second plate, and to secure the vessel at the center of the first surface of the second plate, by rotating the first and second plates with respect to each other, wherein a content of the vessel is mixed by rotating the first plate, the second plate, and the vessel about their respective centers.

2. The apparatus of claim 1, wherein the spiral groove extends from about a center of the first surface of the first plate toward an outer periphery of the first surface of the first plate in a spiral path, wherein each of the plurality of clamping posts is connected to a first member, the first member including a protrusion passing through the second surface of the second plate, wherein the protrusion is inserted in the spiral groove, and wherein each of the plurality of clamping posts moves toward the center of the first surface of the second plate or away from the center of the first surface of the second plate when the first and second plates are rotated with respect to each other.

3. The apparatus of claim 2, wherein the mixing apparatus further includes a guard and the second plate further includes a pin, wherein the guard is configured to be moved between a first position and a second position, wherein, when disposed at the first position, the guard is coupled with the pin such that the guard prevents the second plate from rotating, and when disposed at the second position, the guard is not coupled with the pin to allow the second plate to rotate.

4. The apparatus of claim 3, wherein when the guard is disposed at the first position, the motor is configured to rotate the first plate in a first direction to move the clamping posts away from the center of the first surface of the second plate, or to rotate the first plate in a second direction opposite to the first direction to move the clamping posts toward the center of the first surface of the second plate.

5. The apparatus of claim 3, wherein when the guard is disposed at the second position, the motor is configured to rotate the first plate, the second plate, and the vessel in a first direction to mix the contents of the vessel.

6. The apparatus of claim 2, wherein at least one of the plurality of clamping posts includes a straight portion.

* * * * *